US008974083B2

(12) United States Patent
Weekamp et al.

(10) Patent No.: US 8,974,083 B2
(45) Date of Patent: Mar. 10, 2015

(54) LOW-COST MULTI FUNCTIONAL HEATSINK FOR LED ARRAYS

(75) Inventors: Johannes Wilhelmus Weekamp, Beek En Donk (NL); Florian Stadler, Eindhoven (NL)

(73) Assignee: Koninklijkle Philips N.V., Eindhoven (NL)

( * ) Notice: Subject to any disclaimer, the term of this patent is extended or adjusted under 35 U.S.C. 154(b) by 30 days.

(21) Appl. No.: 13/879,844

(22) PCT Filed: Oct. 13, 2011

(86) PCT No.: PCT/IB2011/054532
§ 371 (c)(1),
(2), (4) Date: Aug. 16, 2013

(87) PCT Pub. No.: WO2012/052889
PCT Pub. Date: Apr. 26, 2012

(65) Prior Publication Data

US 2013/0322078 A1 Dec. 5, 2013

(30) Foreign Application Priority Data

Oct. 21, 2010 (EP) ..... 10188362

(51) Int. Cl.
*F21V 21/00* (2006.01)
*F21V 29/00* (2006.01)
*F21Y 101/02* (2006.01)

(52) U.S. Cl.
CPC ..... *F21V 29/22* (2013.01); *F21V 29/2293* (2013.01); *F21V 29/262* (2013.01); *F21Y 2101/02* (2013.01)
USPC ..... 362/249.02; 362/249.01; 362/249.06

(58) Field of Classification Search
USPC ..... 362/249.02, 249.06, 249.01
See application file for complete search history.

(56) References Cited

U.S. PATENT DOCUMENTS

2008/0170396 A1 7/2008 Yuan et al.
2009/0236616 A1* 9/2009 Ku ..... 257/88

FOREIGN PATENT DOCUMENTS

| | | | |
|---|---|---|---|
| CN | 201429055 | Y | 3/2010 |
| CN | 101818871 | A | 9/2010 |
| JP | 2003209296 | A | 7/2003 |
| JP | 2006310667 | | 11/2006 |
| JP | 2007242244 | A | 9/2007 |
| WO | 2007124277 | A2 | 11/2007 |
| WO | 2009033051 | A1 | 3/2009 |

OTHER PUBLICATIONS

H. K. Ma et al; "Study of an LED Device With a Honeycomb Heat Sink", 26th IEEE Semi-Therm Symposium, 2010, pp. 289-299.

* cited by examiner

*Primary Examiner* — Evan Dzierzynski
(74) *Attorney, Agent, or Firm* — Meenakshy Chakravorty

(57) ABSTRACT

A lighting device having a cell structure (101) of polygonal cells (105), which is a heat sink, and light sources (103) arranged to be cooled by the cell structure. The light sources are arranged in at least some of the cells, one light source in each cell. The light sources are attached to the cell structure and electrically connected with the cell structure, which in turn is arranged to provide the light sources with power.

7 Claims, 5 Drawing Sheets

LOW-COST MULTI FUNCTIONAL HEATSINK FOR LED ARRAYS

FIELD OF THE INVENTION

The present invention relates to a lighting device and a method of manufacturing the same, wherein the lighting device comprises a cell structure of polygonal cells, which is a heat sink, and light sources arranged to be cooled by the cell structure.

BACKGROUND OF THE INVENTION

Lighting devices using arrays of light sources are of great interest for applications such as backlight for displays and illumination panels. Such arrays are typically made by arranging the light sources, such as for example LEDs (Light Emitting Diodes) on a large area PCB (Printed Circuit Board). Further, since illumination applications are desirable, often high power light sources are requested, causing a need for a heat sink on which the PCB is mounted. However, the large area PCB is relatively expensive. A lighting device of basically the presented kind is shown in WO 2007/124277, where the lighting device includes columns of LED light sources mounted on printed circuit boards. The boards are arranged on a heat sink. This prior art solution uses several smaller PCBs, which may reduce the cost to a certain extent. On the other hand, the wiring is increased, which is negative.

SUMMARY OF THE INVENTION

It is an object of the invention to provide a lighting device providing a less expensive solution.

The object is achieved with a lighting device and a method of manufacturing a lighting device according to the present invention as defined in the appended claims.

Thus, according to one aspect of the invention, there is provided a lighting device comprising a cell structure of polygonal cells, which is a heat sink, and light sources arranged to be cooled by the cell structure. The light sources are arranged in at least some of the cells, one light source in each cell, and are attached to and electrically connected with the cell structure. The cell structure is arranged to provide the light sources with power.

According to another aspect of the invention, there is provided a method of manufacturing a lighting device, comprising:

providing a heat sink as a cell structure of polygonal cells;

arranging the light sources in at least some of the cells, one light source in each cell;

thermally connecting the light sources with the cell structure by attaching the light sources to the cell structure;

electrically connecting the light sources with the cell structure; and providing the cell structure with power supply terminals.

A heat sink cell structure of polygonal cells is known per se from WO 2007/124277, but merely as a heat sink supporting the PCBs. However, according to the present invention the PCBs have been omitted and the light sources are individually mounted in the cells of the cell structure. Thus, no additional common support structure is needed for supporting the light sources. Furthermore, the cell structure is employed as both heat sink and electric connector for the light sources.

According to an embodiment of the lighting device, the cell structure comprises several wall elements, wherein each cell that contains a light source is formed by at least two wall elements, which are electrically insulated from each other.

Thereby a simple power supply structure is obtained where the wall elements are used as conductors.

According to an embodiment of the lighting device, the wall elements are strips, which have been bent to form the polygonal cells. This structure provides for a simple manufacture.

According to an embodiment of the lighting device, the wall elements are electrically interconnected in groups, each group having a common power supply terminal. Thereby a simple power supply connection is obtained.

According to an embodiment of the lighting device, each light source is attached to the cell structure by means of combined thermally and electrically conducting connections. Thereby a simple interface between the light source and the cell structure is achieved.

Corresponding embodiments of the manufacturing method provide corresponding advantages, and will not be further explained.

BRIEF DESCRIPTION OF THE DRAWINGS

The invention will now be described in more detail and with reference to the appended drawings in which.

DESCRIPTION OF PREFERRED EMBODIMENTS

Figure 1:
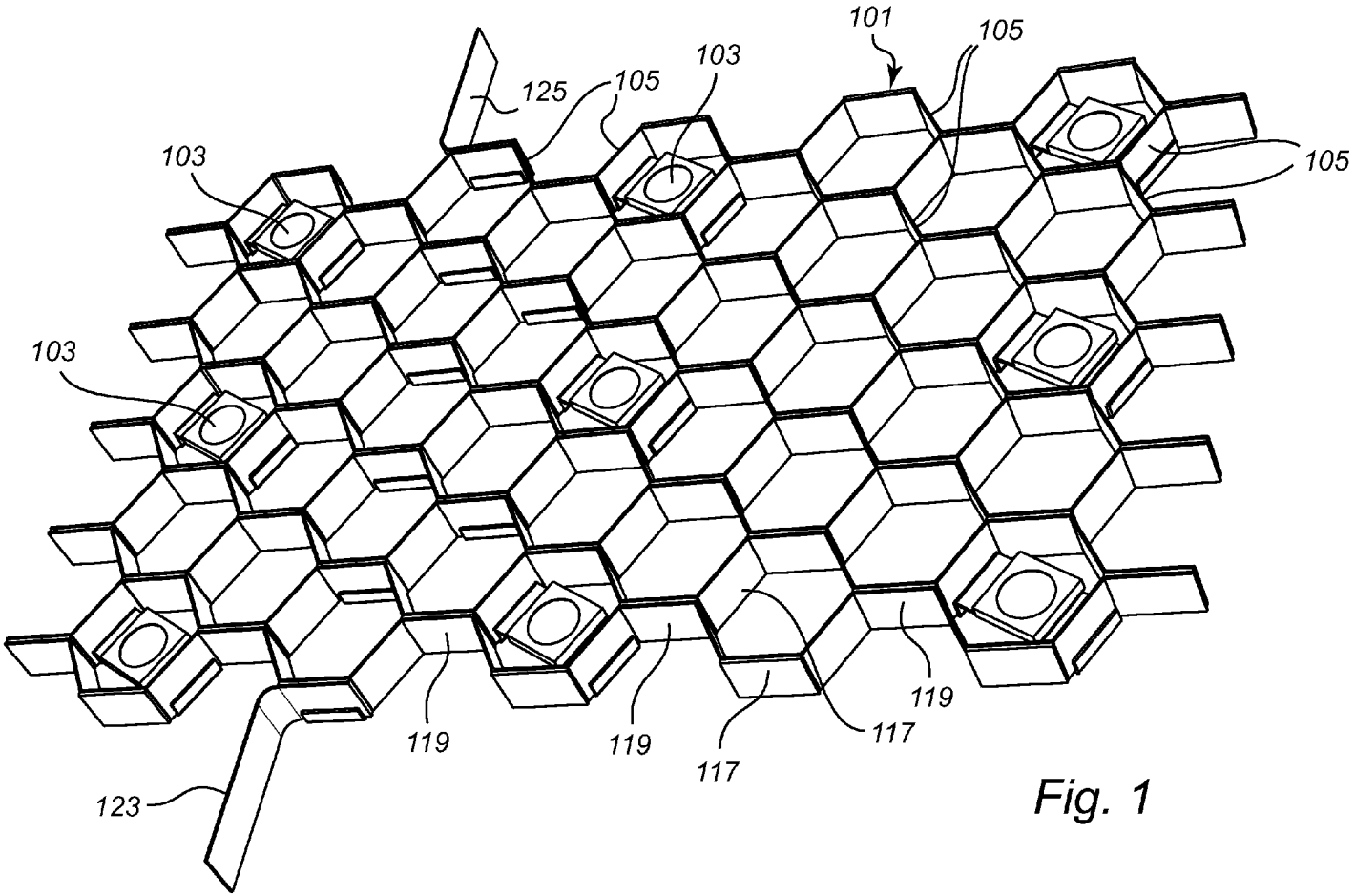
FIG. 1 is a schematic front perspective view of an embodiment of the lighting device according to the present invention.

According to an embodiment the lighting device of the present invention, as shown in the figures, it comprises a cell structure of polygonal cells 101, and light sources 103 arranged in cells 105 of the cell structure 101. More particularly, the cells 105 are hexagonal and are arranged adjacent to each other. Thus, the cell structure 101 constitutes a honeycomb structure. However, alternative cell shapes are possible, such as squares, rectangular or trapezium shapes, all depending on bond line width and rate of extension. The cell structure 101 is made from a material which is a good thermal and electric conductor, such as aluminium, copper, steel, alloys and metal plated materials. This is since the cell structure 103 is employed as an electric conductor for supplying power to the light sources 103, and as a heat sink for the light sources 103. Consequently, the light sources 103 are attached to the cell structure 101 by means of electrically and thermally conducting connections as will be further described and exemplified below.

Figure 2:
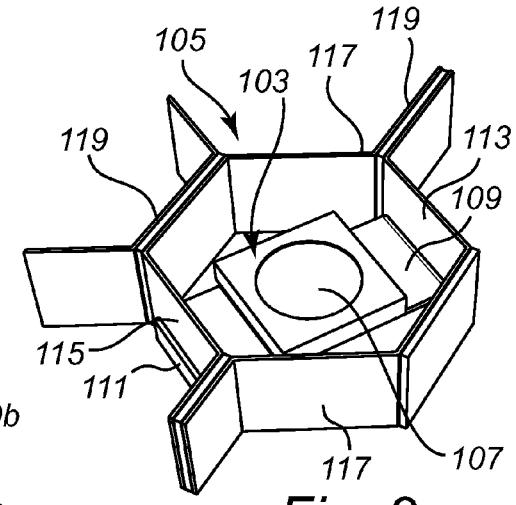
FIGS. 2 and 3 are respectively schematic front perspective and rear perspective views of a portion of the lighting device shown in FIG. 1.
Figure 3:
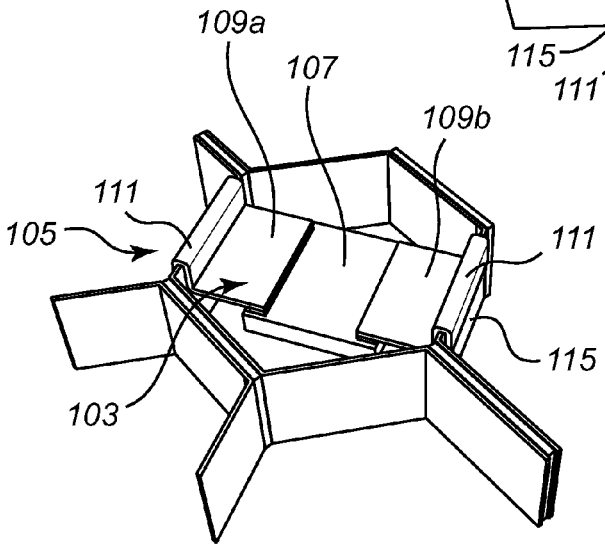

The light sources 103 are arranged in at least some of the cells 105. As best seen in FIGS. 2 and 3, each light source 103 is physically attached to the cell 105. The light source 103 comprises a light emitter, here LED, 107, and a light emitter support 109, which has an attachment portion 111 at each respective end thereof. In this embodiment the emitter support 109 is constituted by two connection pieces 109*a*, 109*b* of copper strip, or some other appropriate material as exemplified above, protruding in opposite directions from the light emitter 107. Each connection piece 109*a*, 109*b* is attached, at one end thereof, to the light emitter 107, and attached, at the other end thereof, to a wall portion 113 of the cell 105 at the attachment portion 111. Thus, the connection pieces 109*a*, 109*b* constitute the above-defined thermally and electrically conducting connections. Since the cells are hexagonal there are six such wall portions 113 embodying the cell 105. Each attachment portion 111 is formed as a 90 degree bend followed by a 180 degree bend in the opposite direction, of an end portion of the piece 109*a, b*, forming a hook shaped portion with a narrow slot. The attachment portion 111 consequently extends perpendicular to a main plane of the light emitter 107, and rearwards thereof. Thereby it is possible to mount the light source 103 in the cell 105 by moving the light source 103 into the cell 105 from a rear side of the cell structure 101, while aligning the attachment portions 111 with the wall portions 113 of the cell 105 such that the wall portions 113 are received in the slots. Then, if necessary, the attachment portions 111 are secured to the wall portions 113, such as by ultrasonic welding or some other method which forms a thermally and electrically conductive bond. Instead of copper other materials are applicable as understood by the person skilled in the art.

Figure 4:
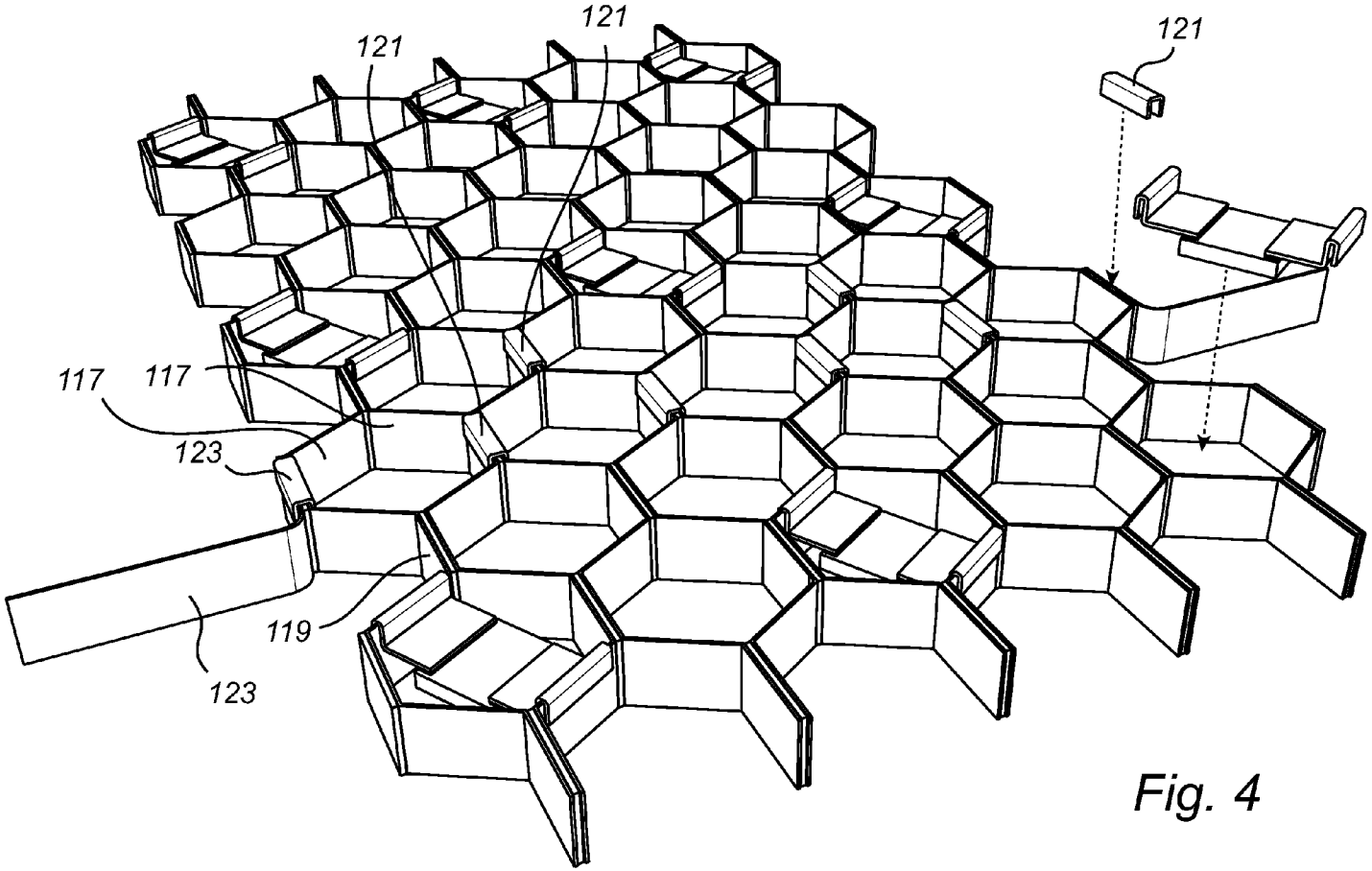
FIG. 4 is a schematic rear perspective view of the lighting device shown in FIG. 1.
Figure 5:
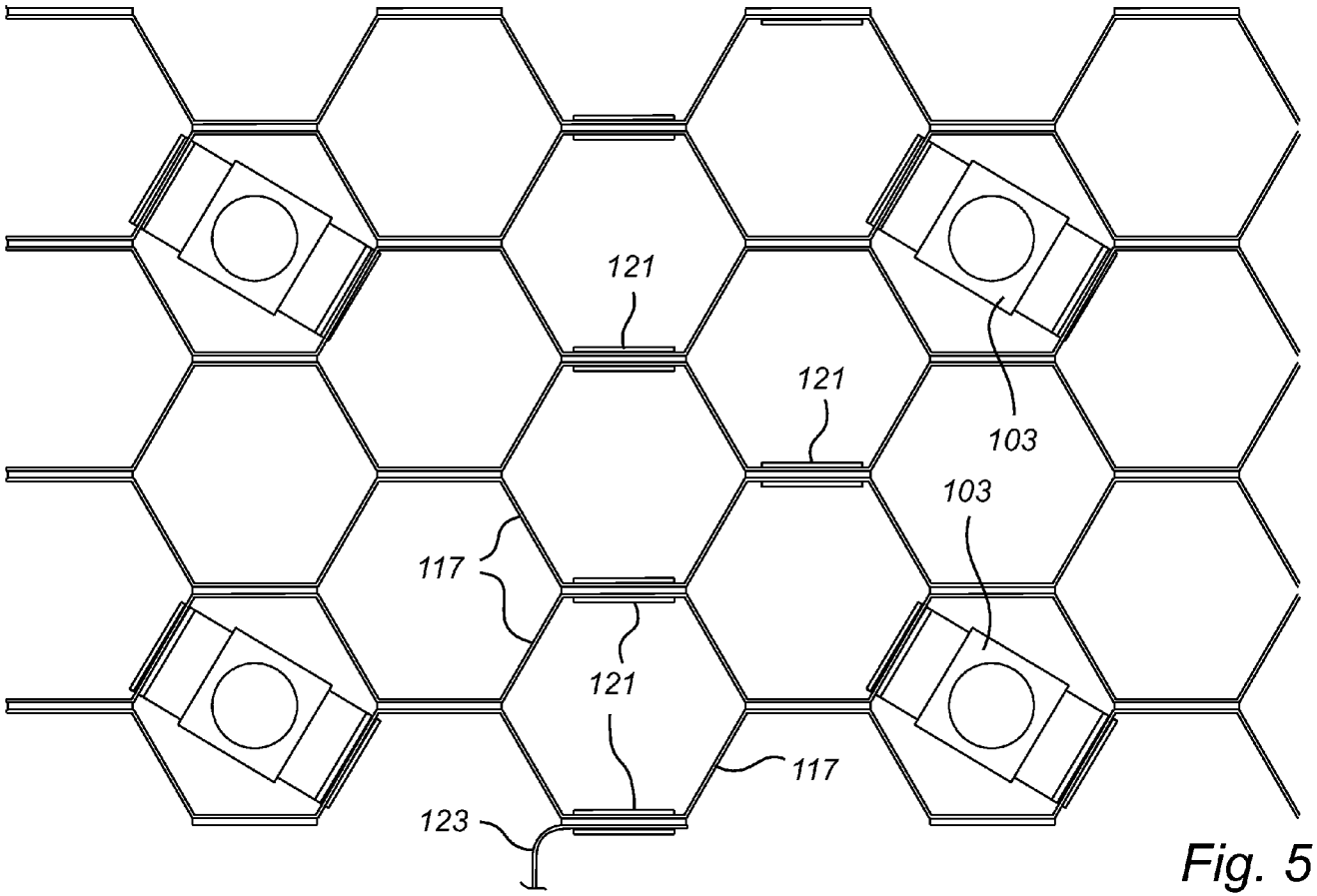
FIG. 5 is a schematic front plan view of a portion of the lighting device shown in FIG. 1.

The cell structure 101 comprises a plurality of wall elements 117, which are strip shaped and which are connected with each other by means of an adhesive at equidistant interconnection portions 119. The polygonal cells 105 have been formed by bending the strip shaped wall elements 117 after adhering them. The adhesive is electrically non-conductive, i.e. insulating, such that two adhesively interconnected adjacent wall elements 117 are electrically insulated from each other. The wall elements 117 are electrically interconnected in groups, by means of interconnection members 121, see FIG. 4. Each group consists of at least two wall elements 117. Each interconnection member 121 is an electrically conductive U shaped clamp that has been clamped over two adjacent wall elements 117 at an interconnection portion 119. Preferably the interconnection clamps 121 are made from the same material as the wall elements 117. Each group of interconnected wall elements 117 has a common power supply terminal 123, 125, which is attached to one of the wall elements of the group. By means of a combination of how the interconnection members 121 and the light sources 103 are arranged in the cell structure 101, the light sources 103 are connected in series and/or in parallel, as illustrated in FIG. 5.

Figure 6:
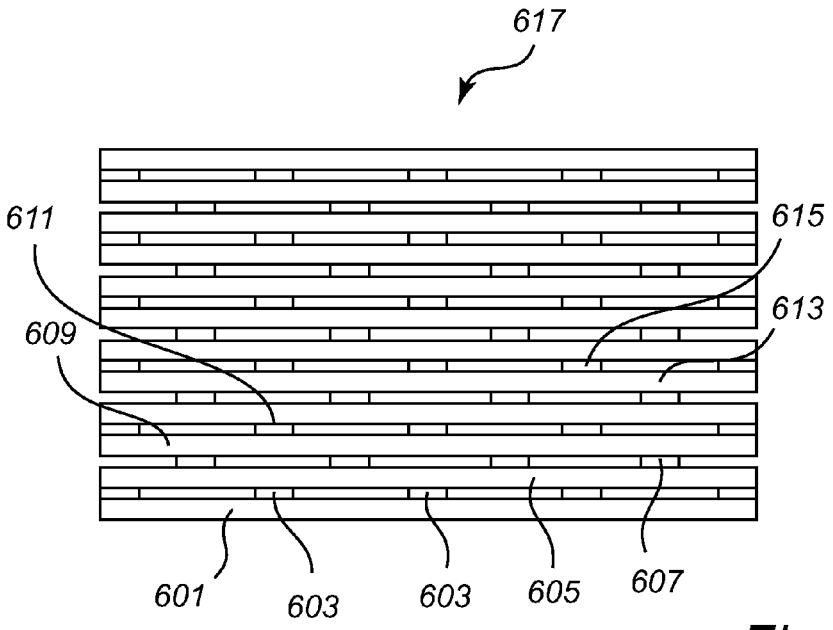
FIG. 6 is a schematic side view of a stack of adhered sheets from which heat sinks are to be cut out and formed.

Referring to FIG. 6, an embodiment of a method of manufacturing the lighting device is performed as follows. A first sheet 601 of an electrically conductive material is placed on a support surface. For example, the sheet is an aluminum foil. The top surface of the sheet 601 is provided with a number of adhesive stripes 603 extending across the width of the sheet 601. The adhesive stripes 603 consist of, for instance, glue or double side adhesive tape. The width of the stripes and the distance between the adhesive stripes 603 determine the size of the cell to be formed at a later stage. Then a second sheet 605 is placed on top of the first sheet 601. Adhesive stripes 607 are provided on the top surface of the second sheet 605. The adhesive stripes 607 on the second sheet 605 are displaced longitudinally of the sheet relative to the adhesive stripes 603 on the first sheet 601. A third sheet 609 having adhesive stripes 611 aligned with those of the first sheet 601, a fourth sheet 613 having the adhesive stripes 615 aligned with those on the second sheet 605, etc. are arranged. Thus, the plurality of sheets are stacked on top of each other, while providing the top surface of all but the top most sheet with a number of adhesive stripes. Then the adhesive is cured, and the stack of sheets 617 is longitudinally cut into several sub-stacks. Finally, each sub-stack is opened to a honeycomb cell structure. More particularly, the sheets of the sub-stack are distanced from each other at the non-adhered portions while forming the cells 105 described above. Where the adhesive stripes have been applied, the final result is the above-mentioned interconnection portions 119.

According to an alternative method of manufacture, a single long foil is rewound several turns on a large diameter drum, while parallel adhesive stripes are applied on the foil surface. The adhesive is cured and then the stacked ring of foil is removed from the drum. Sub-stacks are cut off and opened into a cell structure.

Above, embodiments of the lighting device and method of manufacturing the lighting device according to the present invention as defined in the appended claims have been described. These should be seen as merely non-limiting examples. As understood by a skilled person, many modifications and alternative embodiments are possible within the scope of the invention.

For instance, light sources of different types are applicable, such as LED's incandescent lamps, Compact Fluorescent, OLED, etc.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A lighting device comprising a cell structure of polygonal cells, and light sources arranged to be cooled by the cell structure, said cell structure comprises several strip shaped wall elements, the light sources arranged in at least some of the polygonal cells, at least one light source in each cell, each cell that contains a light source being formed by at least two wall elements which are electrically insulated from each other, the light sources are attached to the cell structure, and the light sources electrically connected to the at least two wall elements by a first and a second light emitter support, the first light emitter support connected to a first wall element by a first attachment portion, the second light emitter support connected to a second wall element by a second attachment portion, the first and second attachment portion a substantially hook shaped portion having a narrow slot, and the cell structure arranged to provide the light sources with power.

2. The lighting device according to claim 1, wherein the wall elements are strip shaped and have been bent to form the polygonal cells.

3. The lighting device according to claim 2, wherein the wall elements are electrically interconnected in groups, each group having a common power supply terminal.

4. The lighting device according to claim 2, comprising interconnection members, wherein each interconnection member electrically interconnects adjacent wall elements.

5. The lighting device according to claim 2, wherein each light source is attached to the cell structure by means of combined thermally and electrically conducting connections.

6. A lighting device, comprising:

a cell structure of a plurality of polygonal cells;

a plurality of light sources arranged to be cooled by the cell structure and arranged in at least some of the polygonal cells;

the cell structure formed from several wall elements;

each cell that contains a light source being formed by at least two wall elements which are electrically insulated from each other;

the light sources affixed to the cell structure;

the light sources electrically connected to the at least two wall elements by a first and a second light emitter supports, both of the first and second light emitter supports electrically and thermally connected to the respective wall element;

a plurality of U-shaped interconnection members clamped over two adjacent wall elements;

wherein the plurality of U-shaped interconnection members electrically join a plurality of the polygonal cells of the cell structure into an electrical group; and the cell structure arranged to provide the light sources with power.

7. A lighting device, comprising:

a cell structure of polygonal cells and light sources arranged to be cooled by the cell structure;

the cell structure comprised of several wall elements;

the light sources arranged in at least some of the polygonal cells, at least one light source in each cell;

each cell that contains a light source being formed by at least two wall elements which are electrically insulated from each other;

the light sources attached to the cell structure;

the light sources electrically connected to the at least two wall elements by a first and a second light emitter support, the first light emitter support connected to a first wall element by a first attachment portion, the second light emitter support connected to a second wall element by a second attachment portion, the first and second attachment portion a substantially hook shaped portion having a narrow slot;

a plurality of U-shaped interconnection members clamped over two adjacent wall elements;

wherein the plurality of U-shaped interconnection members electrically join a plurality of the polygonal cells of the cell structure into electrical groups; and the cell structure arranged to provide the light sources with power.

* * * * *